United States Patent [19]

Yung-Mao

[11] Patent Number: 4,843,741

[45] Date of Patent: Jul. 4, 1989

[54] CUSTOM INSERT WITH A REINFORCED HEEL PORTION

[75] Inventor: Lin Yung-Mao, Taichung, China

[73] Assignee: Autry Industries, Inc., Dallas, Tex.

[21] Appl. No.: 276,409

[22] Filed: Nov. 23, 1988

Related U.S. Application Data

[63] Continuation-in-part of Ser. No. 245,758, Sep. 16, 1988, which is a continuation-in-part of Ser. No. 153,222, Feb. 8, 1988, which is a continuation-in-part of Ser. No. 025,010, Mar. 12, 1987, Pat. No. 4,733,483.

[51] Int. Cl.[4] ..... A43B 5/00; A43B 13/14; A43B 13/18

[52] U.S. Cl. ..... 36/114; 36/28; 36/30 R; 36/32 R; 36/136

[58] Field of Search ..... 36/28, 29, 43, 44, 3 R, 36/3 B, 14, 114, 30 R, 32 R, 15, 100, 101, 107, 136

[56] References Cited

U.S. PATENT DOCUMENTS

| | | | |
|---|---|---|---|
| D. 129,487 | 9/1941 | Kardo-Sessoeff . | |
| D. 199,300 | 10/1964 | Martin . | |
| D. 236,562 | 9/1975 | Wunsch et al. . | |
| D. 247,140 | 2/1978 | Sorge . | |
| D. 256,066 | 7/1980 | Hagg et al. . | |
| D. 260,196 | 8/1981 | Plagenhoef . | |
| D. 261,946 | 11/1981 | Trask . | |
| D. 287,782 | 1/1987 | Palacio . | |
| D. 293,849 | 1/1988 | Peel . | |
| 74,912 | 2/1868 | Hadley . | |
| 945,698 | 1/1910 | Conway . | |
| 1,540,430 | 5/1922 | Sims . | |
| 1,559,532 | 10/1925 | Smith | 36/28 |
| 2,090,881 | 8/1937 | Wilson | 36/29 |
| 2,146,888 | 2/1939 | Fisch | 36/44 X |
| 2,721,400 | 10/1955 | Israel | 36/28 X |
| 2,885,797 | 5/1959 | Chrencik | 36/28 X |
| 4,045,886 | 9/1977 | Terasaki . | |
| 4,075,772 | 2/1978 | Sicurella . | |
| 4,095,353 | 6/1978 | Foldes . | |
| 4,103,440 | 8/1978 | Lawrence | 36/101 |
| 4,187,620 | 2/1980 | Selner | 36/28 |
| 4,215,492 | 8/1980 | Sandmeier . | |
| 4,297,796 | 11/1981 | Stirtz et al. | 36/28 |
| 4,319,412 | 3/1982 | Muller et al. | 36/29 |
| 4,364,188 | 12/1982 | Turner et al. | 36/30 R |
| 4,364,189 | 12/1982 | Bates | 36/30 R |
| 4,509,510 | 4/1985 | Hook . | |
| 4,510,704 | 4/1985 | Johnson | 36/136 |
| 4,551,930 | 11/1985 | Graham et al. . | |
| 4,598,484 | 7/1986 | Ma . | |
| 4,680,875 | 7/1987 | Daniezi | 36/28 X |
| 4,733,483 | 3/1988 | Lin | 36/28 |
| 4,817,304 | 4/1989 | Parker et al. | 36/114 |

FOREIGN PATENT DOCUMENTS

| | | | |
|---|---|---|---|
| 0215995 | 4/1987 | European Pat. Off. | 36/29 |
| 3228017 | 7/1983 | Fed. Rep. of Germany | 36/3 R |
| 2573633 | 5/1986 | France | 36/44 |
| 59-68802 | 9/1984 | Japan | 36/25 R |
| 2007081 | 5/1979 | United Kingdom | 36/32 R |

OTHER PUBLICATIONS

Runner's World, May 1988, vol. 23, No. 5, p. 19.
WO87/07481, 12/1987, WIPO, Comfort.
WO82/03753, 11/1982, WIPO, Johnson.
"Nike Air Stab" Publication, Feb. 1988.

*Primary Examiner*—James Kee Chi
*Attorney, Agent, or Firm*—Baker, Mills & Glast

[57] ABSTRACT

A midsole (12 and 24) for an activewear shoe (10) comprises a removable insert (12) and a peripheral member (24). The peripheral member (24) is joined to the perimeter of an upper surface (20) of an outsole (16). A plurality of independent cushioning elements (40) depend from a base member (38) of insert (12), and are sized in order to conform to the depth of peripheral member (24). A window (14) is formed through the peripheral member (24) and/or the outsole (16) to allow observation of the insert (12) from exterior the shoe (10). To reinforce the peripheral member (24) proximate the window (14), a row of stiffened cushioning elements (62) is formed on the insert (12). The stiffened elements (62) have a higher durometer reading than the remaining elements (40) and are formed during an injection molding process. A transverse reinforcing segment (31) may be provided to inhibit movement of the insert (12) within the shoe (10). If desired, the segment (31) and the elements (40) may be formed with cavities therein to lighten the weight of the shoe (10).

9 Claims, 1 Drawing Sheet

CUSTOM INSERT WITH A REINFORCED HEEL PORTION

RELATED APPLICATION

This application is a continuation-in-part of co-pending U.S. application Ser. No. 245,758 filed Sept. 16, 1988 which along with copending U.S. application Ser. No. 207,202 filed June 16, is a continuation-in-part of co-pending U.S. application Ser. No. 153,222 filed Feb. 8, 1988 which in turn is a continuation-in-part of Ser. No. 025,010 filed Mar. 12, 1987, now U.S. Pat. No. 4,733,483, Mar. 29, 1988 and is related to copending U.S. application Ser. No. 180,529 filed June 16, 1988, which is a continuation-in-part of copending U.S. application Ser. No. 097,806 filed Sept. 17, 1987 (now abandoned), which is in turn a divisional of U.S. Pat. No. 4,733,483, Mar. 29, 1988.

TECHNICAL FIELD OF THE INVENTION

This invention relates in general to athletic or other activewear shoes, and more particularly to shoes having custom midsoles with a removable insert that has a reinforced heel portion to provide added support to the wearer.

BACKGROUND OF THE INVENTION

Athletic or other activewear shoes of a conventional construction generally have three or four separate parts. First, such shoes are generally provided with an outsole made of a durable material and which extends across the lower surface of the shoe. A midsole is joined to the outside to provide a cushioning layer to the wearer's foot. Usually, an upper formed of leather, synthetics or other materials is joined to the midsole. In many conventional structures, an insole is further positioned between the midsole and the wearer's foot for additional cushioning.

The midsoles of these conventional constructions have two undesirable characteristics. First, they have the property of deforming over a large area of surface when a downward force is impressed on them. Second, the midsoles are affixed to the shoes and therefore customers can make no choice in the midsole's cushionability without selecting another shoe. Thus, conventional midsoles do not offer independent suspension or deformation of various selected areas thereof, and further are suited to only a particular weight class or cushionability preference of wearers.

The need for a midsole having a plurality of cushioning elements, each demonstrating an individual suspension and deforming independently from the remaining elements has generally been met by the custom midsole as disclosed in U.S. Pat. No. 4,733,483, Mar. 29, 1988, to Lin, and assigned to the present assignee. However, a need has arisen for a midsole which can be better tailored for specific support. Moreover, it is desirable to provide a see-through window that allows observation of the midsole. Unfortunately, a window in the sole of a shoe may result in weakening of that portion of the sole. Thus there is a need for a custom midsole that may reinforce the weakened window portion of a sole, while also counteracting the tendency of a wearer to pronate or supinate.

SUMMARY OF THE INVENTION

The present invention disclosed herein comprises a method and apparatus for an improved midsole insert having a reinforced heel portion which substantially eliminates or reduces problems associated with prior midsole inserts. The present invention reinforces the heel portion of an insert to counteract and reinforce the weakening of an area of the shoe caused by the insertion of an observation window therethrough. The present inventin also helps in counteracting pronation or supination by the wearer.

In accordance with one aspect of the invention, a bottom surface of a shoe insert is provided with a plurality of individual cushioning elements. A row or area of the elements is stiffened along one edge of the insert to provide additional edge support.

In another aspect of the present invention, a shoe having an edge weakened by the insertion therein of a see-through observation widow is reinforced by the stiffened row of elements. Alternatively, the stiffened row of elements may be positioned to counteract the effects of pronation or supination.

It is a technical advantage of the present invention that a shoe having a weakened area therein by the addition of an observation window may be strengthened. It is a further technical advantage that a tendency of the wearer to pronate or supinate may be counteracted.

BRIEF DESCRIPTION OF THE DRAWINGS

Various aspects of the invention and their advantages will be more completely understood by reference to the following Detailed Description in conjunction with the appended Drawings in which.

DETAILED DESCRIPTION OF THE INVENTION

Figure 1:
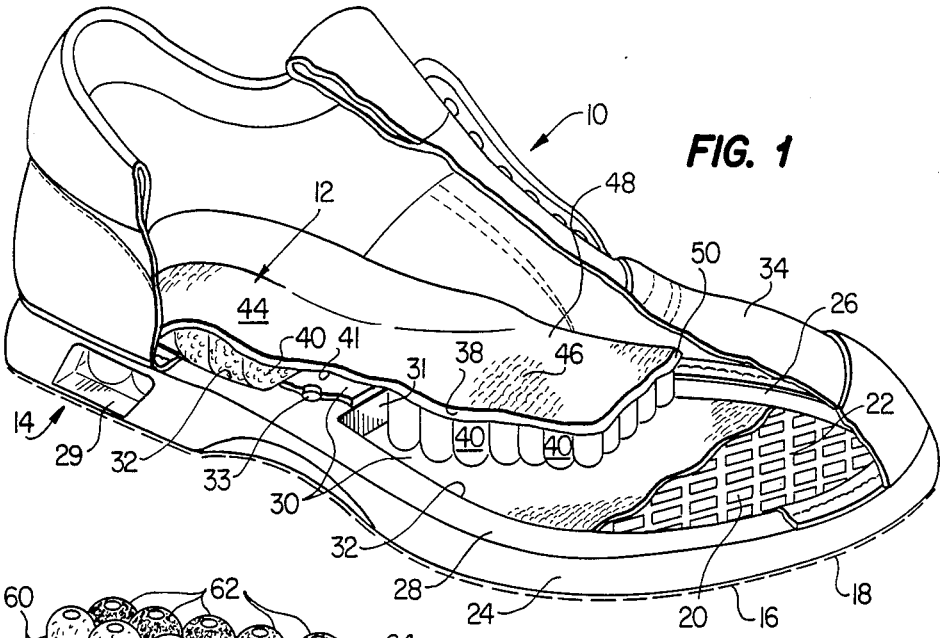
FIG. 1 is an isometric view of a shoe construction according to the invention as fitted with a reinforced custom midsole therefor, with parts broken away to show interior structure.

Referring first to FIG. 1, an isometric view of a shoe constructed in accordance with the preferred embodiment of the present invention is generally indicated by the reference numeral 10. A custom midsole insert 12 is shown fitted into an active wear shoe with an observation or see-through window 14 for viewing the insert 12 from external the shoe 10. While the illustrated shoe 10 is designed for walking, the invention can also be employed in other types of athletic shoes, such as running, aerobics, or court shoes.

The shoe 10 comprises an outsole 16 that forms the wearing surface of the shoe. The outsole 16 is preferably constructed of a relatively durable, resilient material such as natural rubber. The outsole 16 has an exterior surface that is provided with a suitable tread surface 18 and an interior or upper surface 20. The upper surface 20 may be smooth and featureless throughout, or may have a central area 22 that is reticulated or webbed in order to save weight. A peripheral area (not shown) of the upper surface 20 presents a smooth surface for gluing or other means of attachment.

A peripheral midsole member 24 is formed to be glued or otherwise attached to the peripheral area of outsole upper surface 20. Peripheral member 24 is more cushionable and yielded than outside 16, and can be conveniently molded of polyurethane foam or ethylene vinyl acetate copolymer (EVA). Peripheral member 24 has an interior sidewall 26 and an upper surface 28. Peripheral member 24 in the illustrated embodiment, extends around the periphery of outsole 16 and is interrupted only by the see-through window 14 which is constructed in accordance with the disclosure in co-pending U.S. application Ser. No. 245,758 which is incorporated herein by reference. The peripheral member 24 is weakened by removal of a portion thereof necessary to insert the window 14. Thus, in an important aspect of the present invention, it is desirable to provide added support to the shoe 10 proximate the window 14 as will be subsequently described in greater detail. It may also be desirable to extend a portion 29 of the outsole 16 over a portion of the window 14 to help strengthen the shoe 10.

Preferably, a footbed reinforcing layer 30 is affixed as by gluing to the outsole upper surface 20. The layer 30 is preferably thinner than the height of the peripheral member 24 to allow room for the insert 12. The reinforcing layer 30 is sized to substantially coincide with the exposed portion of the outsole upper surface 20.

The layer 30 is fabricated of a relatively resilient, firm and less flexible material than the EVA forming the peripheral member 24, for example, a leatherized paper or cardboard. The purpose of the layer 30 is to replace torsional strength lost by the creation of the peripheral midsole member 24. Thus, a midsole/outsole configuration having satisfactory torsional strength is formed for proper lateral support of the wearer's foot while at the same time providing for a central insert 12 having selectable cushionability.

A transverse reinforcing segment 31 may be formed in accordance with the disclosure in co-pending U.S. application Ser. No. 245,758. The segment 31 may have a plurality of cavities 33 (only one of which is shown) formed therein to lighten the overall weight of the shoe 10 without detracting from the stability and support function of the segment 31.

The peripheral member 24 forms a receptacle 32 (divided by segment 31) that is diemnsioned to receive the insert 12. The shoe 10 further comprises an upper 34 that can be fashioned of leather, cloth, synthetic materials or a combination of these, and is attached to the upper surface 28 of the peripheral member 24.

The insert 12 comrpises an upper base member 38 and a plurality of supporting elements 40 that are preferably formed integrally with base member 38 to depend therefrom, as further shown and described in co-pending application Ser. No. 245,758. As shown, the elements 40 occupy the receptacle 32 when the insert 12 is installed into the shoe 10. The elements 40 are dimensioned such that their depth matches the depth of the sidewall 26 minus the thickness of the layer 30, and are formed to occupy substantially all of the receptacle 32 from one sidewall 26 to the other. The peripheral member 24 and the removable insert 12 are apportioned such that most of the weight of the wearer will be borne by the insert 12. Of primary importance to the present invention, certain ones of the elements 40 are formed from a material that has a higher durometer reading (i.e., they are stiffer) than the rest of the elements 40, as will be subsequently described in greater detail.

The insert 12 has a transverse slot 41, formed by eliminating certain ones of the elements 40, corresponding to the transverse reinforcing segment 31. The base member 38 has an upper surface 44 onto which a flocking material 46, which is preferably formed of a polyester/nylon material but can be formed of any suitable fabric, is joined as by gluing. When finished out by the flocking material 46, the insert 12 does not require any insole or liner on top of it to be suitable for wearing.

As shown, base member 38 has a central member 48, and a lip member 50 extending beyond the central area 48 with the cushioning elements 40 depending therefrom. The lip member 50 is formed to be coextensive with the top surface 28 of the peripheral member 24 to present a cushional upper surface 44 to the wearer's foot.

Figure 2:
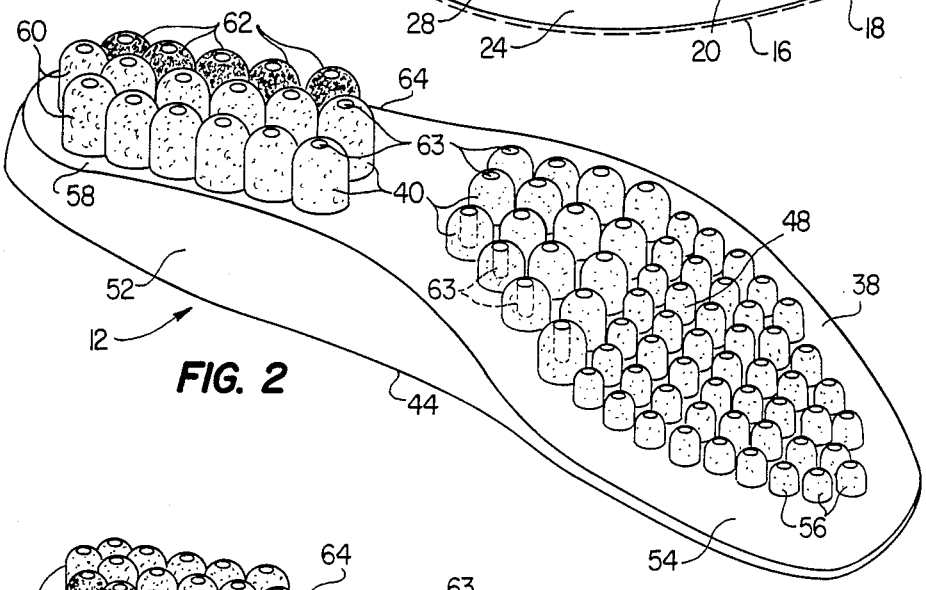
FIG. 2 is a bottom isometric view of a preferred embodiment of a custom midsole insert of the invention.

Referrig now to FIG. 2, a bottom isometric view of insert 12 is shown. In the illustrated embodiment, insert 12 is integrally formed with an insole portion 52. In the embodiment shown in FIG. 2, the upper surface 44 comprises the upper surface of the insole portion 52, and the flocking material 46 (FIG. 1) is joined to this surface.

The elements 40 each take the form of a pillar with a rounded free end, although it will be understood that the elements could have different configurations. The elements 40 are formed in the central area 48 in a close packing arrangement in order to provide cushionable support throughout the central area 48. The elements 40 are formed independently of each other, and are joined only to the base 38. In this manner, the elements 40 provide a multiple-point independent suspension. This is because the elements 40 will be compressed and will yield independently of each other. This is an advantage over midsoles or insoles of solid construction, which have a tendency to yield and compress continuously and uniformly over large areas. The discrete elements 40 on the other hand give an independent, discontinuous support to different portions of the foot that is not obtainable by a midsole or insole of uniform construction.

The elements 40 are graduated in size in order to conform to the depth of the the sidewall 26 (FIG. 1) and to provide different cushioning characteristics. In a front area 54 of the area 48, a plurality of relatively small elements 56 conform to the relatively thin depth of the peripheral member 24. In a heel region 58, a relatively small number of large heel cushioning elements 60 are formed. The larger size of the elements 60 adapts them to the larger depth of the peripheral member 24 in the heel region 58. Further, since there is a larger cushioning depth of material, the larger size of the elements 60 prevents undue bending or nonradial deformation, as might otherwise occur if a greater member of long, thin elements were used.

Of primary importance to the present invention, as previously mentioned above, is that certain ones of the elements 40 are made stiffer than the remaining elements 40. In the embodiment shown in FIG. 2, a row of stiffer elements 62 is formed along an outside edge 64 corresponding to the window 14 formed in the peripheral member 24 (FIG. 1). Since it was necessary to remove a portion of the peripheral midsole member 24 to install the window 14, the strength of the midsole member 24 is correspondingly reduced. Thus it is preferable to provide stiffer elements 62 as a substitute for the removed midsole portion.

The stiffer elements 62 comprise, for example, polyurethane having a higher durometer than any of the other elements 40. The elements 62 are preferably formed integrally with the elements 40 in an injection molding process. Alternatively, the insert 12 may be constructed of two parts, each part formed from different materials of different stiffness, and the two parts being glued together to form an integral insert. If desired, it is possible to lighten the overall weight of the shoe 10 and the insert 12 by forming generally cylindrical cavities 63 in each of the elements 40. Although not shown, it is to be understood that the cavities 63 may have other shapes such as conical or spherical.

Figure 3:
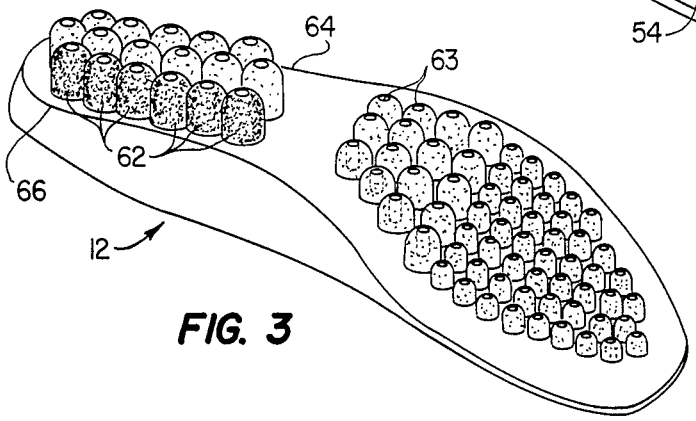
FIG. 3 is a bottom isometric view of an alternative embodiment of a custom midsole insert of the invention.

Referring to FIG. 3, an alternative embodiment of the custom midsole 12 is illustrated. The midsole 12 is constructed and arranged to place the stiffer elements 62 along an inside edge 66 of the shoe 10 rather than along the outside edge 64. Such an arrangement could be used in any shoe having an insert to counteract the tendency to pronate. It will be understood that other configurations could be formed with stiffer elements oriented in a variety of designs.

In operation, shoes 10 and inserts 12 may be distributed to retailers as separate items. Each insert 12 has a specific durometer reading that measures the relative yieldability or resiliency of the elements 40. If the insert 12 is to be used with a window 14 (or any other weakened peripheral midsole member 24) a row of stiffer elements 62 having a higher durometer than the elements 40 is provided to strengthen the area around the window 14. If no window is used but a customer wants to counteract supination, a row of stiffer elements 62 may be positioned along the outer edge 64 of the insert 12. If the wearer wants to counteract the effects of pronation, a row of stiffer elements 62 may be placed along the inner edge 66 of the insert 12.

In summary, a novel midsole with a custom insert has been provided in order to vary the resiliency and cushionability of the midsole according to the wearer's needs and to support the inner or outer edge of the shoe. A stiffer row of elements is properly positioned in the heel region of the insert to reinforce the weakened area around an observation window. Additionally, stiffer elements may be positioned to counteract pronation or supination.

While preferred embodiment of the invention and their advantages have been described above, the invention is not limited thereto but only by the spirit and scope of the claims which follow.

What is claimed is:

1. An improved shoe having a removable insert for a midsole receptacle, wherein the improvement comprises:

a plurality of cushioning elements depending from a lower surface of the insert, said cushioning elements providing cushioning support to the foot of the wearer, said cushioning elements having distinctive visual design aspects;

an observation window formed of transparent plastic through a portion of the shoe for observing said visual design aspects of the insert; and a plurality of said cushioning elements being stiffer than surrounding cushioning elements and formed to be disposed proximate said window to reinforce the shoe.

2. The shoe of claim 1, wherein ones of said cushioning elements comprise plastic material having a first durometer reading.

3. The shoe of claim 2, wherein said stiffer cushioning elements comprise plastic material having a second durometer reading higher than said first durometer reading.

4. The shoe of claim 1, further including a transverse reinforcing segment formed within the shoe to inhibit movement of the insert within the shoe.

5. The shoe of claim 4, wherein said reinforcing segment is formed with at least one cavity therein to lighten the weight of the shoe.

6. The shoe of claim 1, wherein said window is formed through the midsole and an outsole of the shoe.

7. The shoe of claim 6, further comprising an outsole extension portion along an edge of the shoe proximate said window to further reinforce the shoe.

8. The shoe of claim 1, wherein said plurality of cushioning elements are formed with a cavity therein to lighten the weight of the insert.

9. A method for providing selective shoe support to the foot of a wearer, comprising the steps of:

positioning a removable insert within a midsole receptacle between the foot of the wearer and a bottom portion of a shoe;

providing cushioning by said removable insert with a plurality of individual cushioning elements depending from said removable insert, said elements having distinctive visual design aspects;

providing an observation window of transparent plastic through a portion of the shoe for observing said visual design aspects; and providing differing degrees of cushioning to at least two portions of the wearer's foot by providing differing stiffnesses to ones of said cushioning elements adjacent said window.

* * * * *